US008087948B2

(12) United States Patent
Ambo et al.

(10) Patent No.: US 8,087,948 B2
(45) Date of Patent: Jan. 3, 2012

(54) WATERPROOF STRUCTURE FOR CONNECTOR HOUSING

(75) Inventors: Tsugio Ambo, Tokyo (JP); Yoshikazu Tanaka, Tokyo (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 599 days.

(21) Appl. No.: 12/224,009

(22) PCT Filed: Feb. 22, 2007

(86) PCT No.: PCT/JP2007/053279

§ 371 (c)(1), (2), (4) Date: Oct. 16, 2008

(87) PCT Pub. No.: WO2007/097394

PCT Pub. Date: Aug. 30, 2007

(65) Prior Publication Data

US 2010/0163303 A1 Jul. 1, 2010

(30) Foreign Application Priority Data

Feb. 23, 2006 (JP) ..... 2006-046587

(51) Int. Cl.
*H01R 13/52* (2006.01)

(52) U.S. Cl. ..... 439/271; 439/752; 439/595

(58) Field of Classification Search ..... 439/272–275, 439/595, 752

See application file for complete search history.

(56) References Cited

U.S. PATENT DOCUMENTS 4,713,021 A * 12/1987 Kobler ..... 439/272
5,356,312 A * 10/1994 Abe et al. ..... 439/587
5,618,206 A * 4/1997 Sawada et al. ..... 439/587
5,720,629 A * 2/1998 Self et al. ..... 439/587
5,879,179 A * 3/1999 Fukuda ..... 439/271
6,152,752 A * 11/2000 Fukuda ..... 439/275
6,494,740 B1 12/2002 Murakami et al.

FOREIGN PATENT DOCUMENTS

JP 4-284381 A 10/1992
JP 11-283693 A 10/1999
JP 2003-31293 A 1/2003
JP 2003-31294 A 1/2003

* cited by examiner

*Primary Examiner* — Truc Nguyen
(74) *Attorney, Agent, or Firm* — Holtz, Holtz, Goodman & Chick, PC

(57) ABSTRACT

A connector housing that is reduced in size in correspondence with reduction in size of a terminal. When a connecting terminal to which an electric wire and a waterproof sealing member are attached is inserted into a terminal accommodating hole from an terminal insertion opening, a step of the waterproof sealing member abuts against a step of the terminal insertion opening and also a taper surface meets a taper surface, preventing water from entering the terminal accommodating hole from the backside. In this state, the waterproof sealing member is pressed toward a connector housing by a rear holder to prevent the waterproof sealing member from falling out of position. Thus, because the terminal insertion opening is sealed, with a part of the waterproof sealing member placed outside the connector housing, the lateral width and vertical width of the terminal accommodating hole can be set to the magnitudes that substantially allow the connecting terminal to pass through the hole.

6 Claims, 2 Drawing Sheets

WATERPROOF STRUCTURE FOR CONNECTOR HOUSING

This application is a U.S. National Phase Application under 35 USC 371 of International Application PCT/JP2007/053279 filed Feb. 22, 2007.

FIELD OF THE INVENTION

The present invention relates to a waterproof structure for connector housing of an extremely miniaturized electrical connector for use in wire harnesses of automobiles.

BACKGROUND OF THE INVENTION

In accordance with progress in performance of electric devices, the number of electric wires provided in various kinds of electric devices such as automobile harnesses has been increased. Therefore, diameters of electric wires have been reduced accordingly, and then connecting terminals for connecting the electric wires have been also miniaturized, and an electrical connector itself has been miniaturized.

DISCLOSURE OF THE INVENTION

Problems to be Solved by the Invention

In a conventional female type connecting terminal with waterproof structure, as shown in FIG. 6, a connecting terminal 1 includes a connecting portion 2 provided at a front end and clamping portions 3*a* and 3*b* formed at a rear end. A core conductor 5 of an electric wire 4 is connected to the connecting terminal at the clamping portion 3*a*. Moreover, a waterproof sealing member 6 made of a synthetic rubber is provided on a sheath of the electric wire 4 and the sealing member 6 is fixed to the connecting terminal 1 by the clamping portion 3*b*. The sealing member 6 is to be brought into contact with an inner wall of a terminal insertion hole formed in a connector housing to prevent water from being introduced into the connector housing through the terminal insertion hole.

In case of accommodating a large number of miniaturized connecting terminals within the connector housing, the connecting terminals could be packed within the connector housing only with a limited density.

In order to attain the waterproof function, the waterproof sealing members 6 have to be inserted into the terminal insertion hole. However, a width of the waterproof sealing member 6 is larger than a width of the connecting terminal 1, and therefore a width of the terminal insertion hole has to be larger than a width of the connecting terminal 1 by a sum of widths of both sides of the waterproof sealing member 6.

A sum of widths of both sides of the waterproof sealing member 6 amounts to at least about 0.5 mm. When a large number of connecting terminals 1 are arranged side by side, a total sum of both sides of waterproof sealing members could not be ignored.

The present invention has for its object to provide a waterproof structure for miniaturized connector housing in which terminal insertion holes can be formed side by side with a small pitch.

Means for Solving the Problems

According to the invention, in order to achieve the above mentioned object, a waterproof structure for connector housing, characterized in that a taper surface is formed on each of inner surfaces of terminal insertion openings formed at rear portions of terminal accommodating hole of the connector housing, that a taper surface corresponding to respective one of said taper surfaces formed on the inner surfaces of terminal insertion openings is formed on each of waterproof sealing members secured to rear portions of connecting terminals, and that said taper surfaces are urged against each other to seal said terminal insertion openings by said waterproof sealing members.

Merits of the Invention

In the waterproof structure for connector housing according to the invention, a part of a waterproof sealing member is placed outside a terminal accommodating hole to attain miniaturization, and may be advantageously applied to electric circuits for automobiles and motorbikes in which miniaturized electrical connectors are required.

EXPLANATION OF THE REFERENCE NUMERALS

Figure 1:
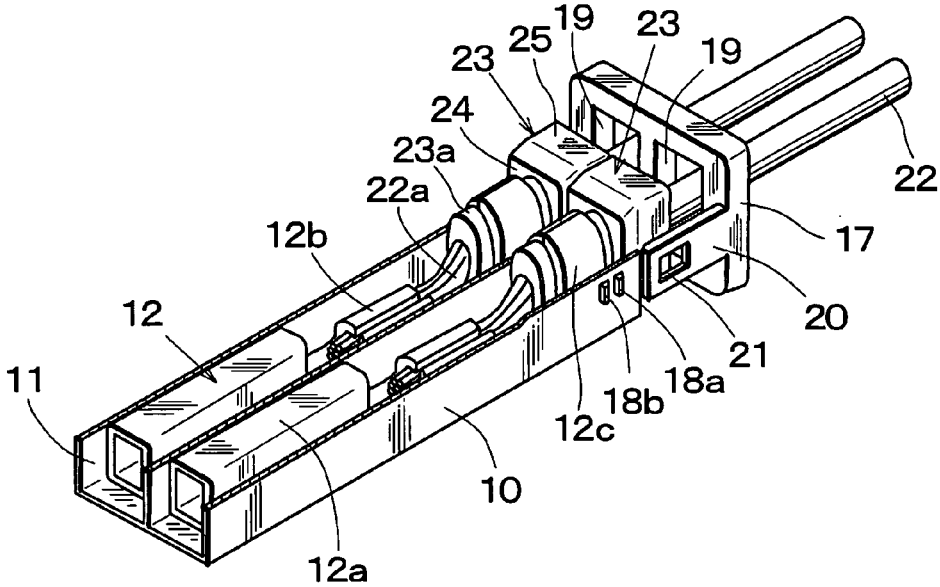
FIG. 1 is a perspective view showing an embodiment of the waterproof structure for connector housing according to the invention.

10 connector housing
11 terminal accommodating hole
12 connecting terminal
14 terminal insertion opening
16, 26 taper surface
17 rear holder
20 arm portion
21 electric wire
23 waterproof sealing member
25 block member

BEST MODES OF THE INVENTION

Figure 2:
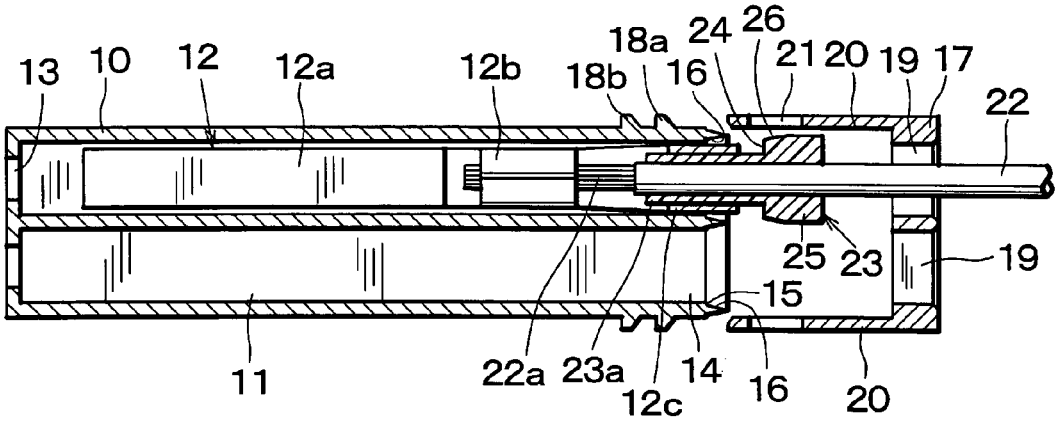
FIG. 2 is a longitudinal cross sectional top view.
Figure 3:
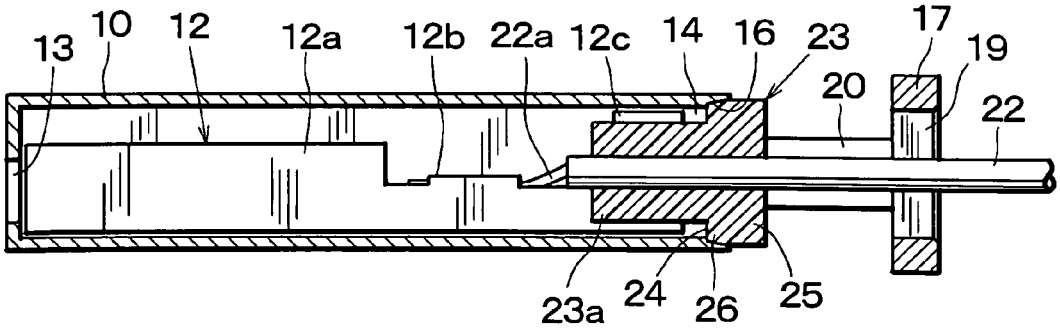
FIG. 3 is a longitudinal cross sectional side view.

FIG. 1 is a perspective view showing a condition in which a connecting terminal 12 is inserted into a terminal accommodating hole 11 of a connector housing 10, and FIGS. 2 and 3 are longitudinal cross sectional top and side views, respectively.

In the connector housing 10 made of a synthetic resin, there are formed two terminal accommodating holes 11 arranged side by side. Each of the terminal accommodating holes 11 has a square cross section having width and height of 1.15 mm which is a minimum value for accommodating a connecting terminal 12. At a front end of the terminal accommodating hole 11 there is formed an opening 13 from which a cooperating connecting terminal is inserted. At a rear end of the terminal accommodating hole 11, there is formed a terminal insertion opening 14 having a step 15 and, furthermore, a tapersurface 16 is formed on each of four innersurfaces of, the terminal insertion opening 14.

On right and left sides of the connector housing 10, there are formed locking claws 18*a*, 18*b* for locking a rear holder 17 to be secured to a rear side of the connector housing 10. The rear holder 17 has formed therein two rectangular openings 19 through which electric wires are to be passed. As will be explained later, the rear holder 17 serves as a block member for pushing waterproof sealing members against the connector housing 10. The rear holder 17 has formed therein arms portions 20 each extending from side walls of the rear holder 17. At front end portions of these arm portions 20, there are formed locking holes 21 which are engaged with the locking claws 18*a*, 18*b* of the connector housing 10.

The connector housing 10 may be advantageously made of a liquid crystal polymer having a fine molding property and a sufficient strength.

At a front end portion of the connecting terminal 12 there is formed a connecting portion 12*a* into which a cooperating connecting terminal is to be inserted. A core conductor 22*a* of an electric wire 22 is clamped to a middle clamp portion 12*b* and the electric wire 22 is clamped to a rear clamp portion 12*c* together with a front end portion 23*a* of a waterproof sealing member 23 made of a resilient material such as a synthetic rubber, particularly silicone rubber. The front end portion 23*a* of the waterproof sealing member 23 is formed as a tubular member having a substantially elliptical cross sectional configuration. That is to say, a thickness of the front end portion 23*a* measured in a vertical direction is larger than a thickness in a lateral direction. The waterproof sealing member 23 is inserted into the terminal accommodating hole 11 with a sufficient margin. A rear portion of the waterproof sealing member 23 is formed into a rectangular block member 25 and a step 24 is formed at a boundary between the front end portion 23*a* and the block member 25. Front end portions of four surfaces of the block member 25 have formed therein taper surfaces 26 which meet the taper surfaces 16 formed at the terminal insertion opening 14 of the terminal accommodating hole 11.

Figure 4:
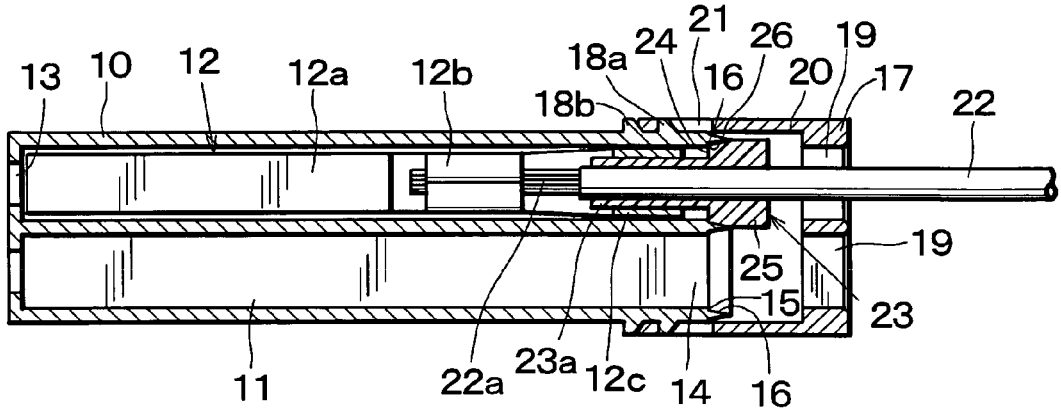
FIG. 4 is a longitudinal cross sectional view depicting a condition in which a rear holder is temporarily fixed to a connector housing.

Upon inserting the connecting terminal 12 with the electric wire 22 and waterproof sealing member 23 into the connector housing 10, at first as shown in FIG. 4, the rear holder 17 is temporarily engaged with the connector housing 10. That is to say, the rear holder 17 is pushed toward the connector housing 10 until the locking holes 21 of the lock arm portions 20 of the rear holder are engaged with the lock claws 18*a* of the connector housing 10 to lock the rear holder 17 with respect to the connector housing 10.

In this condition, the connecting terminal 12 having the electric wire 22 secured thereto is inserted into the terminal accommodating hole 11 through the rectangular opening 19 of the rear holder 17 from the backside. During this operation, the waterproof sealing member 23 is also passed through the rectangular opening 19 while the resilient waterproof sealing member is deformed.

In this manner, the connecting terminal 12 having the electric wire 22 and waterproof sealing member 23 secured thereto is inserted into the terminal accommodating hole 11 from the terminal insertion opening 14. Then, the step 24 formed between the tubular front end portion 23*a* and the block member 25 abuts against the step 15 of the terminal insertion opening 14 and an insertion depth of the connecting terminal 12 is limited. At the same time, the taper surfaces 26 of the block portion 25 are urged against the taper surfaces 16 of the terminal insertion opening 14.

Figure 5:
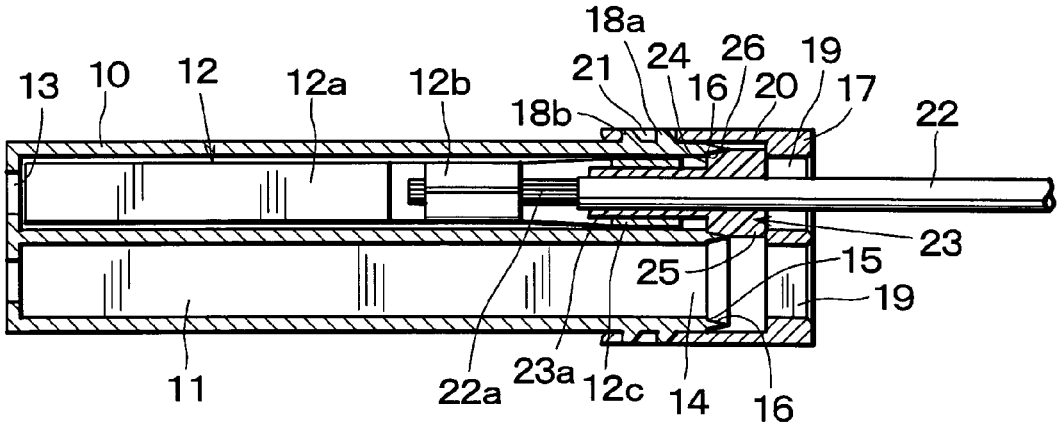
FIG. 5 is a longitudinal cross sectional view illustrating a condition in which the rear holder is locked to the connector housing.
Figure 6:
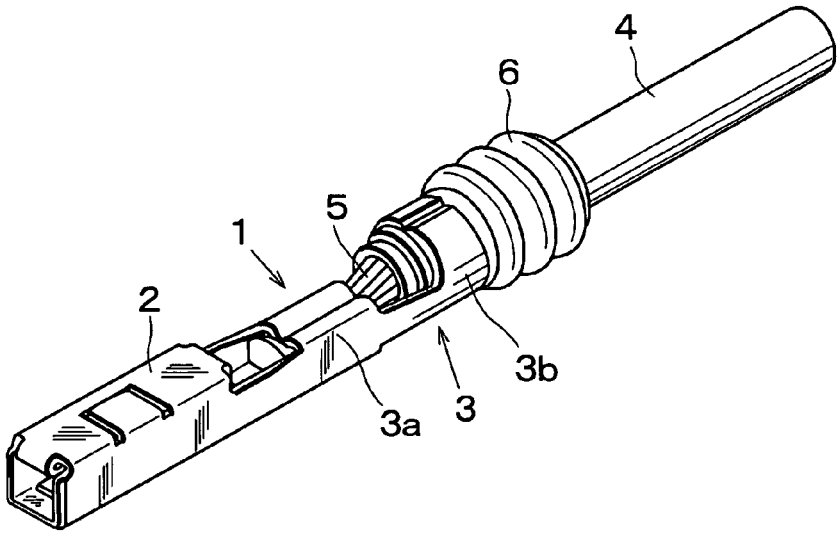
FIG. 6 is a perspective view showing a conventional connecting terminal with a waterproof sealing member.

In this condition, as illustrated in FIG. 5, the rear holder 17 is further pushed to urge the waterproof sealing member 23 against the connector housing 10, and the terminal insertion opening 14 of the terminal accommodating hole 11 of the connector housing 10 is filled with the waterproof sealing member 23. In this manner, water could not be introduced into the terminal accommodating hole 11 from rear side.

During this operation, the locking holes 21 of the arm portions 20 of the rear holder 17 are engaged with the lock claws 18*b* of the connector housing 10, and the rear holder 17 is finally locked to the connector housing 10 while the rear holder 17 is subjected to a large repelling force of the resiliently compressed waterproof sealing member 23.

In the present invention, the waterproof sealing member 23 is not fully inserted into the terminal accommodating hole 11, but a part of the waterproof sealing member 23 is placed outside the connector housing 10. Therefore, a vertical size and a horizontal size of the terminal accommodating hole 11 can be reduced to such values that the connecting terminal 12 can be inserted into the terminal accommodating hole 11, while the effective waterproof structure can be attained. In this manner, the connector can be miniaturized.

In the present embodiment, there are formed two terminal accommodating holes 11 within the connector housing 10, but the number of the terminal accommodating holes is not limited to two. The number of terminal accommodating holes 11 aligned in a row or column may be determined at will. In FIGS. 2-5, only one connecting terminal 12 is inserted into the connector housing 10 for the sake of explanation, but other connecting terminal 12 may be inserted into the other terminal accommodating hole 11 as well.

In the above embodiment, the terminal insertion opening 14 is formed to have a rectangular cross sectional shape, but may be formed to have a circular or elliptical cross sectional shape. In this case, the waterproof sealing member 23 may be formed to have a corresponding cross sectional shape. In the embodiment mentioned above, the connecting terminal 12 is of the female type, but according to the invention, a male type connecting terminal may be equally used.

What is claimed is:

1. A waterproof structure for a connector housing comprising a waterproof sealing member which is provided around an electric wire secured to a connecting terminal that is inserted into a terminal accommodating hole formed within the connector housing such that a terminal insertion opening of the terminal accommodating hole is filled with the waterproof sealing member to prevent water from entering the terminal accommodating hole, wherein:

said terminal insertion opening of the terminal accommodating hole is formed to have a rectangular cross sectional shape, a taper surface is formed on each of four inner surfaces of said terminal insertion opening, a front portion of said waterproof sealing member is formed to have a substantially elliptical cross sectional shape and is secured to the electric wire by a clamp portion of the connecting terminal, a rear portion of said waterproof sealing member is formed to have a rectangular cross sectional shape and a taper surface is formed on each of four outer surfaces of said rear portion of the waterproof sealing member, said taper surfaces of the waterproof sealing member are urged against said taper surfaces of the terminal insertion opening to seal said terminal insertion opening, said waterproof sealing member is urged against the connector housing by means of a rear holder, and said rear holder is locked to the connector housing.

2. The waterproof structure according to claim 1, wherein a step is formed at said terminal insertion opening, and a step is formed on said waterproof sealing member, and wherein said steps abut against each other to limit an insertion depth of the waterproof sealing member.

3. The waterproof structure according to claim 1, wherein the rear portion of the waterproof sealing member is adapted so as to be sandwiched between the terminal insertion opening and the rear holder.

4. The waterproof structure according to claim 1, wherein the rear portion of the waterproof sealing member is adapted so as to substantially be positioned outside the terminal accommodating hole.

5. The waterproof structure according to claim 1, wherein:

the rear holder has an opening and arm portions extending from side walls thereof, and the rear holder is adapted to be temporarily engaged with the connector housing via the arm portions;

the waterproof sealing member is adapted to pass through the opening of the rear holder from a backside while the rear holder is temporarily engaged with the connector housing; and when the rear holder is locked to the connector housing, the waterproof sealing member is urged against the connector housing, and the rear holder serves as a block member for pushing the waterproof sealing member against the connector housing.

6. The waterproof structure according to claim 2, wherein the taper surfaces of the waterproof sealing member and the step formed on the waterproof sealing member, are formed next to each other, and wherein the taper surfaces of the terminal insertion opening and the step formed at the terminal insertion opening, are formed next to each other.

* * * * *